US008267305B2

(12) United States Patent
Rosendall

(10) Patent No.: US 8,267,305 B2
(45) **Date of Patent: *Sep. 18, 2012**

(54) CARRIER HANDLE FOR PLANT TRAY/POT

(75) Inventor: Eric A. Rosendall, Grand Ledge, MI (US)

(73) Assignee: The John Henry Company, Lansing, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/882,573

(22) Filed: Sep. 15, 2010

(65) Prior Publication Data

US 2011/0000808 A1 Jan. 6, 2011

Related U.S. Application Data

(63) Continuation of application No. 11/584,867, filed on Oct. 23, 2006, now Pat. No. 7,857,197.

(51) Int. Cl.
*B65D 5/475* (2006.01)

(52) U.S. Cl. ..... 229/117.19; 220/755; 220/759; 220/769; 220/770; 220/775; 229/117.25

(58) Field of Classification Search ..... 229/117.19, 229/117.23, 117.24, 117.25, 117.26; 220/754, 220/770, 776, 755, 759, 760, 768, 769, 775
See application file for complete search history.

(56) References Cited

U.S. PATENT DOCUMENTS

| | | | | |
|---|---|---|---|---|
| 556,877 | A | 3/1896 | Beers | |
| 687,704 | A | 11/1901 | Unser | |
| 2,128,723 | A | 8/1938 | Zettler | |
| 2,289,824 | A | 7/1942 | Brogden | |
| 2,468,695 | A | 4/1949 | Wallace et al. | |
| 2,760,716 | A | 8/1956 | Weiner | |
| 3,144,196 | A | 8/1964 | Sindars | |
| 3,707,806 | A | 1/1973 | Toews et al. | |
| 3,927,812 | A | 12/1975 | Winters et al. | |
| 4,039,121 | A | 8/1977 | Crane | |
| D292,696 | S | 11/1987 | Sahli | |
| 4,986,420 | A | 1/1991 | Gunn et al. | |
| 5,137,209 | A | 8/1992 | Roberts et al. | |
| 5,161,710 | A | 11/1992 | Chumley | |
| 5,431,334 | A | 7/1995 | Mattson | |
| 5,520,284 | A | 5/1996 | Gray | |
| 5,927,009 | A | 7/1999 | Vanwingerden | |
| 5,937,463 | A | 8/1999 | Hutton et al. | |
| 6,014,850 | A | 1/2000 | LeMire | |
| 7,039,996 | B2 | 5/2006 | Crawley | |
| 7,857,197 | B2 * | 12/2010 | Rosendall | 229/117.19 |

OTHER PUBLICATIONS

2007/0124996 entitled Plant Flat Handle to Hall, published on Jun. 7, 2007, now abandoned.

Photograph of prior art plant tray handles.

* cited by examiner

*Primary Examiner* — Gary Elkins

(74) *Attorney, Agent, or Firm* — Price Heneveld LLP

(57) ABSTRACT

A carrier handle for insertion into a plant tray or pot includes highly flexible locking tabs at opposite ends. Each of the opposed ends includes a generally triangular tab which deflects for ease of insertion into an aperture in a tray or pot. The handle includes a center section with inwardly projecting concave indentations for defining a handhold centered for balancing the item being carried.

11 Claims, 2 Drawing Sheets

CARRIER HANDLE FOR PLANT TRAY/POT

CROSS-REFERENCE TO RELATED APPLICATIONS

This application is a continuation of U.S. patent application Ser. No. 11/584,867 filed on Oct. 23, 2006, entitled PLANT TRAY/POT HANDLE, the entire disclosure of which is incorporated herein by reference.

BACKGROUND OF THE INVENTION

The present invention relates to a flexible polymeric plant tray handle with ends which can be lockably inserted into apertures in plant trays for carrying plant trays or lockably inserted into apertures in plant pots for carrying such pots.

Live plants are frequently sold in trays which comprise relatively thin polymeric rectangular members having an array of rows and columns of sections for individual starter plants. Such trays, when loaded with starter plants and soil, are difficult to handle due to their thinness and somewhat flexible nature. Typically, it requires two hands for carrying such plant trays without such trays deflecting and spilling their contents. Although some polymeric handles with locking tabs at opposite ends have been proposed for carrying a variety of items, such as drink containers and the like, as well as plant trays, they have had insertion tabs which are somewhat difficult to use. Thus, there remains a need for a carrying handle for plant trays and/or plant pots which are easy to install and yet provide the desired locking ability for coupling the handle to the tray or pot. Once installed, it is easy for the retailer and/or consumer to handle during the shelving or purchasing and transporting of such plant trays or pots.

SUMMARY OF THE INVENTION

The handle of the present invention has improved, highly flexible locking tabs at opposed ends of the handle. Further, the handle body includes laterally inwardly extending concave indentations which define finger grips for ease of carrying a tray of plants.

The resultant handle, with ends which can be easily inserted into practically any shape aperture and which engages both sides of the edges of the aperture formed in a plant tray or plant pot allows the handle to withstand the weight of the contents of the tray or pot and facilitates their transportation. The polymeric handles are relatively inexpensive to manufacture and easy to use.

These and other features, objects and advantages of the present invention will become apparent upon reading the following description thereof together with reference to the accompanying drawings.

DETAILED DESCRIPTION OF THE PREFERRED EMBODIMENT

Figure 1:
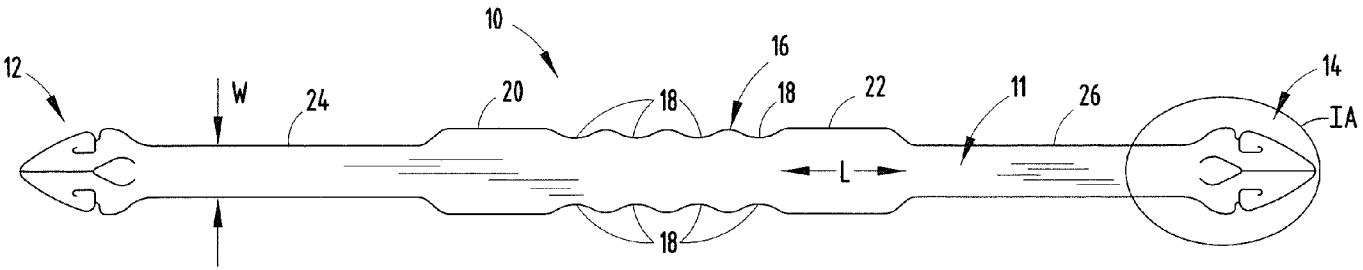
FIG. 1 is a plan view of a handle embodying the present invention.
Figure 6:
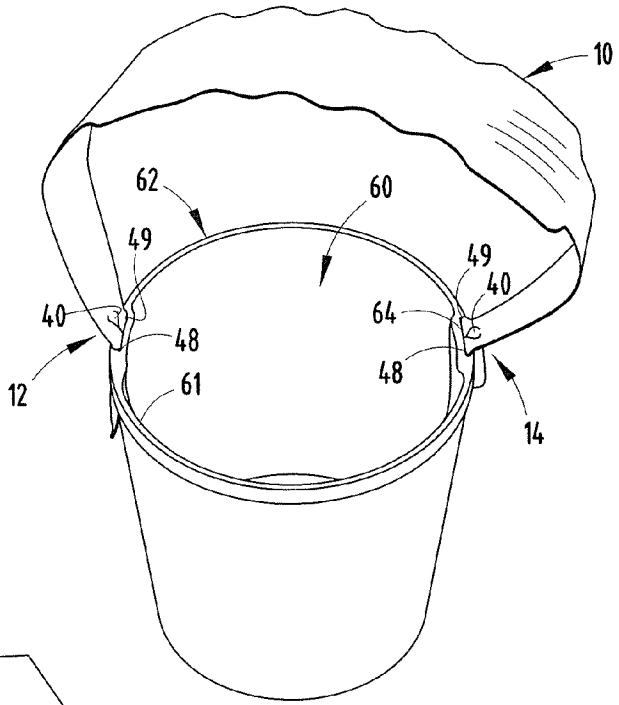
FIG. 6 is a perspective view of the handle mounted within slots in a flower pot.

Referring initially to FIG. 1, there is shown a handle 10 embodying the present invention. Handle 10 has an elongated strap-like shaped body 11 with a longitudinal axis L. The handle is die cut and is substantially symmetrical about the axis L. Handle 10 has opposed locking ends 12 and 14, which are substantially identical in shape. Between the ends, there is a central handle area 16 with indented finger grips 18 to facilitate handling of items such as a plant tray 50, shown in FIGS. 3-5, or for carrying a pot 60, as shown in FIG. 6.

The body 11 of handle 10 is made from a flexible polymeric material, such as polypropylene, high density polyethylene, or any other suitable material which is weather resistant and has sufficient strength to carry the weight of a tray of live plants or live plants in a pot. The unique geometry of the locking ends 12 and 14 facilitate the insertion of the ends of handle 10 into apertures of any configuration in a tray or pot as described in greater detail below. The body 11 of handle 10 has a length of from about 12 to 24 inches and preferably a length of about 18 inches when used in connection with trays, such as tray 50 shown in FIGS. 3-5. The handle can be somewhat shorter when employed with pots, such as shown in FIG. 6. The thickness of the handle is from about 0.015 inches to about 0.040 inches, and preferably about 0.022 inches. The width of the leg sections indicated at arrow W in FIG. 1 can vary from about ½ to about 1 inch, with the preferable width W being about ¾ inch. In FIG. 1, the relative dimensions are shown in proportion with the length of one embodiment of the handle being 19 inches and the width W being ¾ inch. Handle section 16 is wider to facilitate carrying of a tray or pot utilizing handle 10.

The finger grips 18 of the center or handle section of handle 10 comprise four concave indentations extending between enlarged body sections 20 and 22. The indentations provide a handhold allowing a user's fingers to fit within indentations 18 to help balance and carry a plant tray or heavy pot. The legs 24 and 26 extend from body sections 20 and 22 to the locking ends 12 and 14 which are substantially identical and have a geometry which allows relatively easy insertion into a variety of aperture shapes within a tray or pot but, once inserted, lockably secure the ends of handle 10 to the tray and/or pot. Inasmuch as the ends 12 and 14 are identical, only end 14 will be described in detail, it being understood that end 12 is the same.

Figure 2:
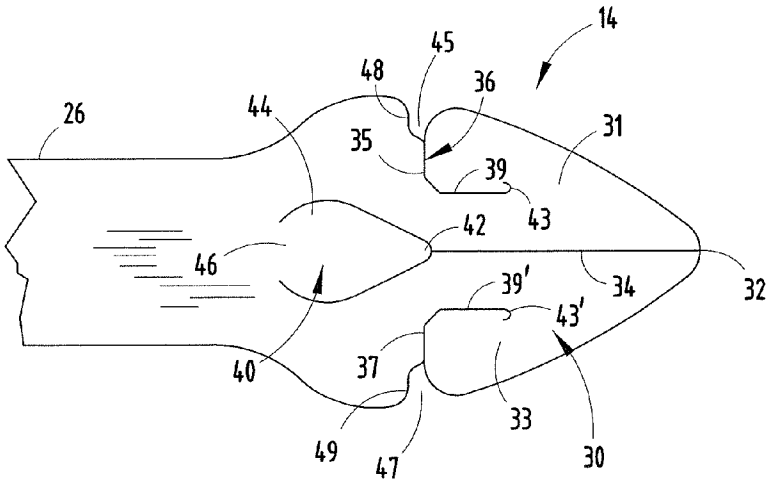
FIG. 2 is an enlarged fragmentary view of one end of the handle.

As best seen in FIG. 2, end 14 includes a generally triangular tab 30 which has a rounded tip 32 and a longitudinally extending slit 34 extending from the tip 32 to the base 36 of tab 30. Slit 34 is aligned with and coaxial with the longitudinal axis L of the body 11 of handle 10 and communicates with a narrowed end 42 of a secondary tab 40 having a widened end 44 joined to the body 11 of handle 10 by hinge 46. The secondary tab 40 is substantially pear-shaped with the narrow end 42 communicating with slit 34 in tab 30. The combination of slit 34 and secondary tab 40 allows the end 14 (and opposite end 12) to be folded by deflecting the flukes 31 and 33 so formed of tab 30 together with laterally extending slits 35 and 37, which define the base 36 of tab 30 allowing such deflection. End 14 further includes lateral inwardly projecting slots 45 and 47 which defines shoulders 48 and 49 facing the base 36 of tab 30 for engaging, as shown in FIG. 4, the top surface of the tray and, similarly, a top surface of a pot when inserted into a pot. Tip end 42 of secondary tab 40 likewise is deflected from the plane of handle body 11 and allows additional flexibility for folding flukes 31 and 33 of tab 30 for insertion into an aperture, such as apertures 54 of tray 50 seen in FIG. 3. The slits 35 and 37 also include end sections 39, 39' which extend in parallel spaced relationship with longitudinal slit 34. The end sections 39, 39' terminate in curved ends 43, 43' to prevent tearing of the flukes when under load during use of the handle. This unique geometry adds to the flexibility of locking ends 12, 14 to allow ease of insertion of tabs 30 while at the same time providing strength to the handle. Tab 30 extends through the apertures in the tray or pot as now described to lockably insert ends 12 and 14 of the handle into the respective tray or pot with the lockable insertion mechanism best illustrated in FIGS. 3-5 now described.

Figure 3:
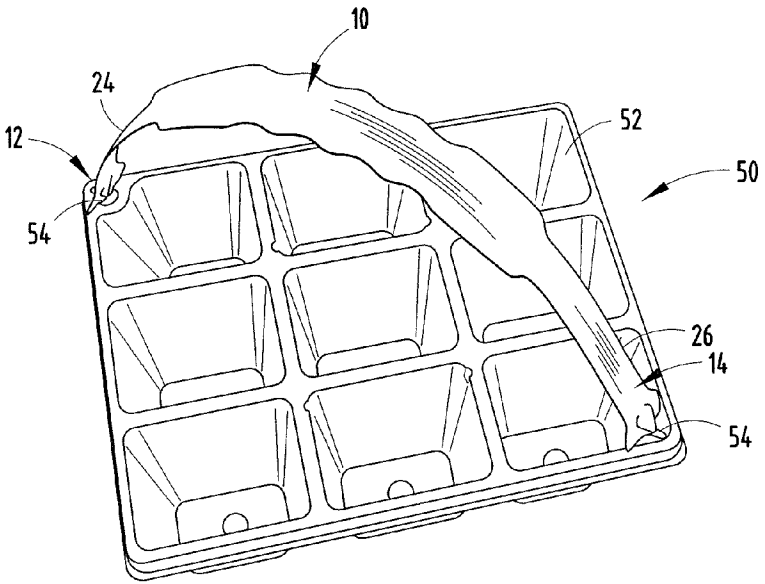
FIG. 3 is a perspective view of the handle inserted into a plant carrying tray.
Figure 5:
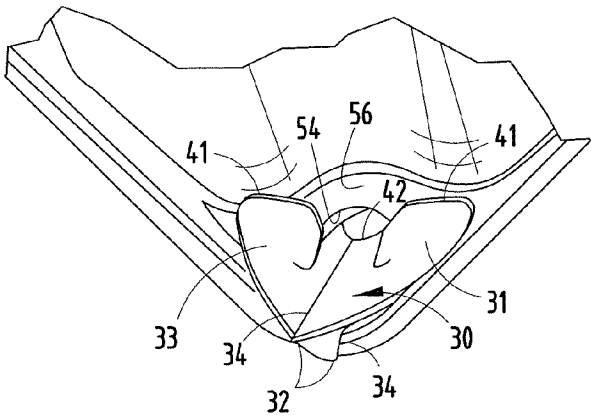
FIG. 5 is a fragmentary bottom perspective view of the corner of the tray shown in FIG. 4, showing the locking mechanism in place within the slot of the tray.
Figure 4:
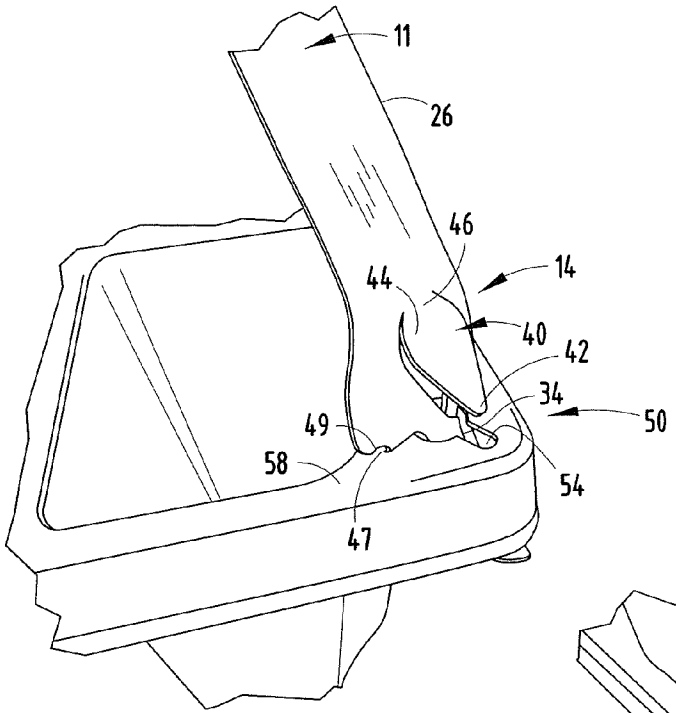
FIG. 4 is an enlarged, fragmentary perspective view of the upper side of one corner of the tray showing the end of the handle inserted into an aperture within the tray.

Referring initially to FIG. 3, there is shown a tray 50 made of a relatively thin polymeric material and including, as an example, an array of nine compartments 52 for receiving live plants to be transplanted upon transportation of tray 50 utilizing handle 10. The tray includes keyhole shaped slots or apertures 54 at diagonally opposed corners through which the locking mechanism on ends 12 and 14 of handle 10 are inserted. Other trays may have spaced-apart apertures located at different locations for receiving the locking ends 12, 14 of handle 10 and differently shaped apertures. The handle is attached to tray 50 by compressing the flukes 31 and 33 of tab 30 such that they overlap, as best seen in FIG. 5 (where they remain partially overlapped after insertion), which the longitudinal slit 34, lateral slits 35, 37, and the secondary tab 40 allow. The insertion of flukes 31 and 33 allow the edges 41 (FIG. 5) of base 36 of tab 30 to engage the lower surface 56 of the tray 50 surrounding aperture 54.

As seen in FIG. 4, the shoulders 48 and 49 of locking ends 12 and 14 engage the upper surface 58 of tray 50 to maintain the ends 12 and 14 of the handle in a locked position within the apertures 54 of tray 50. Secondary tab 40 deflects outwardly, as seen in FIG. 4, to add flexibility to the deflection of tab 30 for its insertion within aperture and secondarily serves to provide an end 42 which also prevents the handle from extending further through aperture 54 than desired. The slots 45 and 47, which define shoulders 48 and 49, can be adjusted in width along the longitudinal axis L of body 11 for different thicknesses of the material to which the locking ends 12 and 14 are attached. When a lifting force is applied by handle 10 to ends 12 and 14, the edges 41 of flukes 31 and 33 tend to spread apart and further lockably engage the underside of tray 50 and prevent removal of the handle 10.

In place of the keyhole-shaped slots 54 employed with the tray 50, as an example, flat rectangular slots, such as arcuate slots 64 formed in the rim 62 of a pot 60 (FIG. 6), can be employed. The locking ends 12 and 14 of handle 10 are inserted within slots 64 in the same manner with the same deflection of tab 30 for its insertion within the slots. In each application, after the insertion of tab 30 through the mounting slots, the flukes 31 and 33 subsequently resiliently return to a shape closely assimilating that shown in FIGS. 1 and 2 to allow the edges 41 of the base 36 to engage the underside of the rim 62 of the pot through which slots 64 are formed, while the shoulders 48 and 49 of the ends 12 and 14 engage the upper surface 61 of rim 62, as seen in FIG. 6.

By providing the longitudinally extending slot 34 in the tabs of the ends of the handle and by additionally providing laterally extending slots 45 and 47 together with the secondary tab 40, the locking ends 12 and 14 of handle 10 can be deflected significantly to fit through practically any geometry aperture in the object to which the handle is attached. Subsequent to its deflection for insertion into the handle due to the resilient nature of the material employed, it tends to spring back to a geometry closer to that shown in FIG. 1, such as illustrated in FIGS. 4 and 5, to lockably engage both the upper and lower surfaces of an object to which the handle is attached. Such construction provides an easily installed handle which serves as a carrying handle for a variety of objects and one which is made of a material which is weather resistant and, once inserted into a container such as a tray or flower pot, is not easily removed and can carry significant weight without concern for failure of the locking mechanism.

It will become apparent to those skilled in the art that various modifications to the preferred embodiment of the invention as described herein can be made without departing from the spirit or scope of the invention as defined by the appended claims.

The invention claimed is:

1. A flexible polymeric handle having opposed ends for lockably inserting into apertures of one of a plant tray or pot, said handle comprising:

an elongated flat polymeric body for carrying plant trays and pots, said body having a thickness of from about 0.015 inches to about 0.040 inches so as to be flexible, said body having a longitudinal axis, said body having opposed ends;

a generally triangular locking tab at each of said opposed ends, said tab including a tip at an end of said body and a base spaced inwardly from said tip, a longitudinally extending slit extending from said tip to said base of each of said tabs to bisect said tab, and a secondary tab aligned with the longitudinal axis of said body and said longitudinal slit, said secondary tab having a wide end and a narrow end wherein said wide end is hinged to said polymeric body and said narrow end is proximate to said tip of said locking tab and communicates with said longitudinally extending slit; and said body includes a center handle section centrally located between said opposed ends, wherein said center handle section includes a plurality of opposed spaced-apart inwardly and transversely extending concave indentations.

2. The handle as defined in claim 1 and further including a widened handle section on opposite sides of said center section.

3. The handle as defined in claim 2 wherein said handle has a length of from about 12 inches to about 24 inches.

4. The handle as defined in claim 3 wherein said handle has a length of about 18 inches.

5. The handle as defined in claim 4 wherein said handle has leg sections between said ends and said handle section with a width of from about ½ inch to about 1 inch.

6. The handle as defined in claim 5 wherein said leg sections have a width of Abut ¾ inch.

7. A flexible polymeric handle having opposed ends for lockably inserting into apertures of one of a plant tray or pot, said handle comprising:

an elongated flexible polymeric body having a longitudinal axis, said body having opposed ends;

a generally triangular locking tab at each of said opposed ends, said tab including a tip at an end of said body and a base spaced inwardly from said tip;

a longitudinally extending slit coaxial with said longitudinal axis of said body and extending from said tip to said base of each of said tabs; and a secondary tab aligned with the longitudinal axis of said body and said longitudinal slit, said secondary tab having a wide end and a narrow end wherein said wide end is hinged to said polymeric body and said narrow end is proximate to and communicates with said longitudinally extending slit, wherein said body includes a pair of opposed laterally extending slots extending inwardly from edges of said body toward said longitudinally extending slit in alignment with the junction of said longitudinally extending slit and said narrow end of said secondary tab at each end of said body;

wherein said pair of opposed laterally extending slots define a shoulder aligned with and longitudinally spaced from said base of said generally triangular tab wherein said shoulder engages a side of a plant tray or pot opposite the triangular tab when inserted into a plant tray or pot; and wherein said body of said handle includes a center handle section centrally located between said opposed ends, wherein said center handle section includes a plurality of opposed spaced-apart inwardly and transversely extending concave indentations.

8. The handle as defined in claim 7 and further including a widened handle section on opposite sides of said center section.

9. The handle as defined in claim 8 wherein said tabs are formed by a pair of opposed laterally extending slits which include sections which extend longitudinally toward said tip of said tab in spaced relationship to said longitudinally extending slit.

10. The handle as defined in claim 9 wherein said handle body is made of one of polypropylene and high density polyethylene.

11. The handle as defined in claim 10 wherein the thickness of said handle is from about 0.015 inches to about 0.040 inches.

* * * * *